United States Patent [19]

Yeh

[11] Patent Number: 4,832,114

[45] Date of Patent: May 23, 1989

[54] DEVICE FOR PRODUCING HIGH HEAT TRANSFER IN HEAT EXCHANGER TUBES

[76] Inventor: Hsu-Chieh Yeh, 1174 Bucknell Dr., Monroeville, Pa. 15146

[21] Appl. No.: 127,705

[22] Filed: Dec. 2, 1987

[51] Int. Cl.[4] ..... F28F 13/02

[52] U.S. Cl. ..... 115/85; 165/109.1; 165/94; 138/38

[58] Field of Search ..... 165/94, 95, 85, 92, 165/109.1, 120, 179; 138/38, 39; 15/104.061

[56] References Cited

U.S. PATENT DOCUMENTS

| | | | |
|---|---|---|---|
| 3,407,871 | 10/1968 | Penny | 165/85 |
| 3,541,628 | 11/1970 | Girard | 15/104.061 X |
| 3,693,329 | 9/1972 | Willis | 138/39 X |
| 4,081,875 | 4/1978 | Nishino | 15/104.061 |
| 4,174,750 | 11/1979 | Nichols | 138/38 X |
| 4,641,705 | 2/1987 | Gorman | 165/85 |
| 4,720,884 | 1/1988 | Ralls | 15/104.061 |

FOREIGN PATENT DOCUMENTS

| | | | |
|---|---|---|---|
| 347904 | 5/1931 | United Kingdom | 165/85 |

*Primary Examiner*—Larry Jones

[57] ABSTRACT

A device to be inserted in heat exchanger tubes to produce high heat transfer in said heat exchanger tubes and, hence, high heat exchanger efficiency. Said device consists of a shaft mounted with a strip and an impeller. The flow of fluid in the heat exchanger tube causes the impeller to rotate, the impeller in turn causes the strip to rotate. The strip has slots and vanes. As the strip rotates, said vanes guide the fluid on and near the inner tube wall to flow through said slots to the central (axial) region of the tube, which promotes the convective heat transfer inside the tube tremendously.

6 Claims, 2 Drawing Sheets

DEVICE FOR PRODUCING HIGH HEAT TRANSFER IN HEAT EXCHANGER TUBES

This invention relates to a device for increasing the efficiency of a heat exchanger by producing high convective heat transfer inside heat exchanger tubes.

The device to be inserted in heat exchanger tubes consists of a shaft mounted with a strip and an impeller. The flow in the heat exchanger tube causes the impeller to rotate, and the impeller in turn causes the strip to rotate. The strip has slots and vanes. As the strip rotates said vanes guide the fluid on and near the inner tube wall (boundary layer) to flow through said slots to the central (axial) region of the tube so as to promote the convective heat transfer inside the tube. As is well known that the greatest temperature gradient (or temperature difference) of the fluid inside a tube occurs on and near the inner tube wall. Thus by allowing the fluid on and near the tube wall to flow to the central (axial) region of the tube, the convective heat transfer is improved tremendously.

It is noted that the mechanism of the heat transfer enhancement in the present invention is basically different from that of the conventional fins and twisted tapes, which are affixed on the tube wall. With fins the heat transfer is enhanced due to the increase of heat transfer area. With twisted tapes affixed on the tube wall the heat transfer is enhanced due to both the increase of heat transfer area and the swirling of fluid. In both cases the fluid on and near the wall stays flowing on and near the wall, whereas in the present invention the fluid on and near the wall is swept and guided to the central (axial) region.

In the foregoing general description the main object and advantage of the present invention have been set out. Other objects and advantages of the present invention will become apparent when considering the following detailed description and appended drawings in which.

Figure 1:
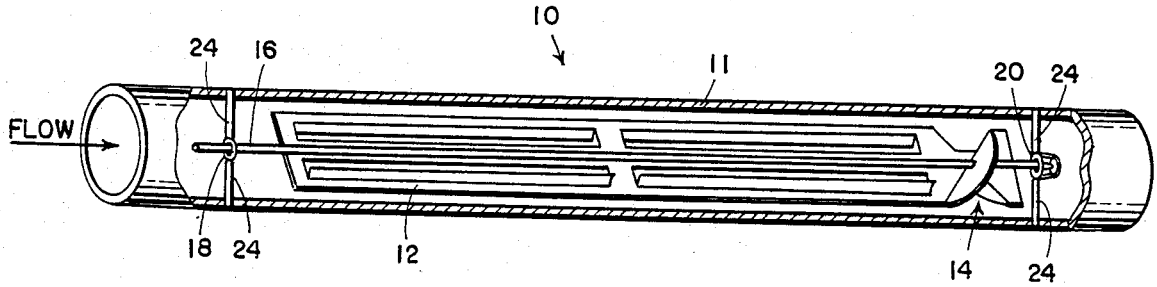
FIG. 1 is a cross-sectional view of a heat exchanger tube showing the embodiment of the present invention which is inserted in the heat exchanger tube.

Referring now to FIG. 1, a preferred embodiment 10 of the present invention is illustrated. Inside a heat exchanger tube 11 a strip 12 and an impeller 14 are mounted on a shaft 16. Shaft 16 is mounted on bearings 18 and 20. Each of bearings 18 and 20 is held at the center of tube 11 by arms 24, which are affixed to the inner wall of tube 11. The flow of the heat exchanger fluid through tube 11 causes impeller 14 and, hence, strip 12 to rotate.

Figure 2:
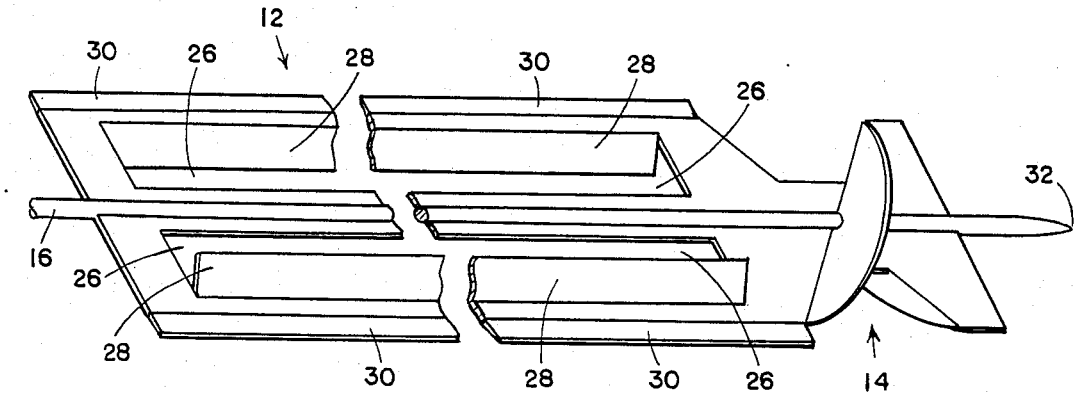
FIG. 2 is an enlarged perspective view of the strip and the impeller.
Figure 3:
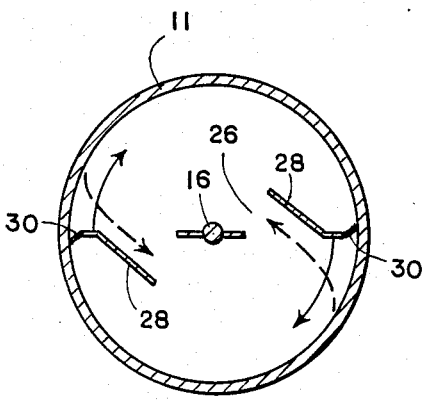
FIG. 3 is a cross-section view of the strip, which is inside the heat exchanger tube, showing slots and vanes and the direction of the rotation of the strip (solid arrows) and the direction of the fluid flow (dashed arrows).
Figure 4:
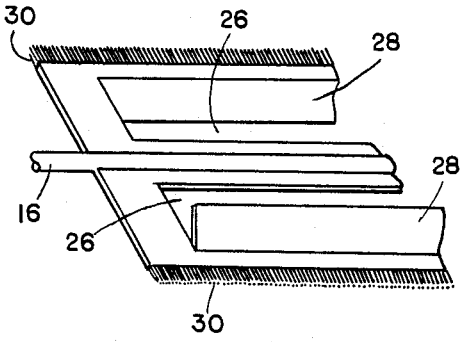
FIG. 4 shows a row of tiny brushes attached on each edge of the strip.

In a tube there may be many strips and impellers. A strip may have many slots and vanes (FIG. 1 shows four slots and four vanes as an illustration). Vane 28 is bended in the direction opposite to the direction of the rotation of strip 12 (The solid arrows in FIG. 3 indicate the direction of rotation of strip 12) so that vane 28 will guide the fluid on and near the inner wall of tube 11 to flow through slot 26 to the central (axial) region of tube 11 (The dashed arrows in FIG. 3 indicate the direction of flow). To sweep the fluid on and near the inner wall of tube 11 a sweeping element 30 (FIGS. 2 and 3), which is a tape (FIG. 2) or a row of tiny brushes (FIG. 4), is attached to each edge of strip 12. Thus the fluid on and near the inner tube wall will be swept and flow through slots 26 to the central (axial) region of tube 11. The sweeping element 30 should be soft enough to avoid undue increase of resistance and pressure drop.

The sweeping of the sweeping element 30 possesses another advantage. It prevents dirt or foreign particles to be deposited on the inner tube wall and thus reduces fouling heat transfer resistance.

Figure 5:
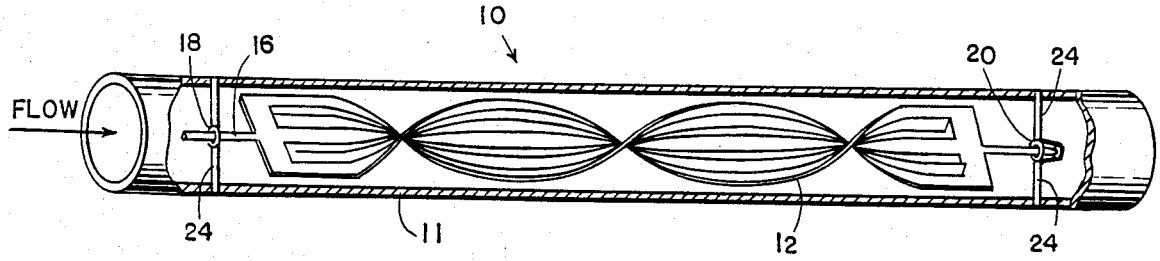
FIG. 5 is a perspective view of the twisted strip inside a heat exchanger tube.

The strip 12 can be twisted as shown in FIG. 5 to provide impeller function. Thus with the strip 12 twisted it is unnecessary to have impeller 14 of FIG. 2.

To reduce the friction the downstream end 32 of shaft 16 ends in a point (FIGS. 2 and 6) and the associated bearing 20 is attached with disc 34 (FIG. 6) by two supporting elements 36. Disc 34 is perpendicular to shaft 16 such that when shaft 16 rotates the downstream end 32 of shaft 16 makes a point contact with disc 34. As the point contact has the smallest friction, this will reduce the friction to a minimum.

Figure 6:
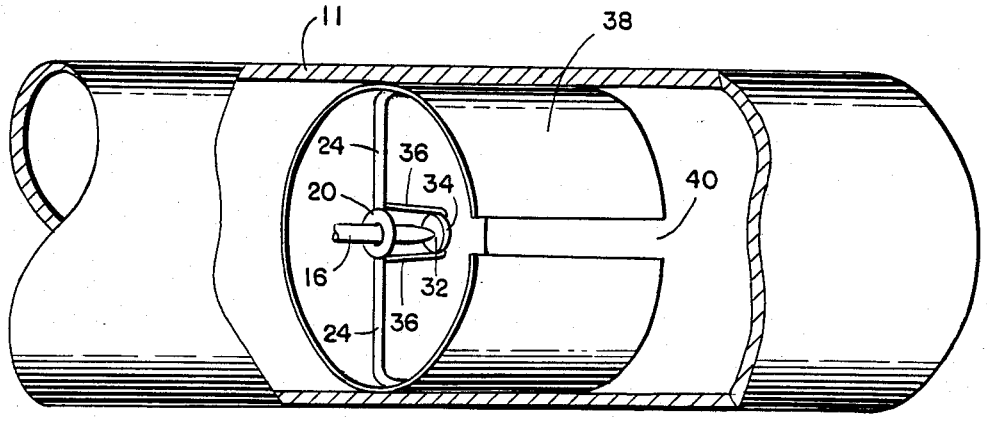
FIG. 6 is a perspective enlarged view of the downstream end bearing and a ring which supports said bearing.

To facilitate the installation of bearings 18 and 20 in tube 11, ring 38 may be used (FIG. 6). Arms 24, which support bearings 18 and 20 are affixed to the inner wall of ring 38. Ring 38 is cut at 40 to provide a spring function for insertion in tube 11. To install bearings 18 and 20 in tube 11, rings 38 with bearings 18 and 20 in them are insert into tube 11 to appropriate positions.

While the invention has been described in its preferred embodiment, modifications and variations will become apparent to those skilled in the art. Such modifications and variations are considered to be within the purview of the following claims:

I claim:

1. A device for improving the convective heat transfer in a heat exchanger tube comprising:

a. a shaft and bearings for supporting said shaft in the heat exchanger tube;

b. a strip affixed on said shaft with an elongated soft material attached on each edge of said strip for sweeping the fluid on and near the inner wall of said heat exchanger tube; and c. vanes and slots on said strip for guiding said fluid on and near the inner wall of said heat exchanger tube to the central (axial) region of said heat exchanger tube, said vanes being bent in the direction opposite to the direction of the rotation of said strip.

2. The invention of claim 1 wherein said elongated soft material attached on each edge of said strip includes a tape.

3. The invention of claim 1 wherein said elongated soft material attached on each edge of said strip includes a row of tiny brushes.

4. The invention of claim 1 wherein said means of guiding the fluid on and near the inner wall of said heat exchanger tube to the central (axial) region of said heat exchanger tube comprises slots and vanes on said strip, said vanes being bended in the direction opposite to the direction of the rotation of said strip.

5. The invention of claim 1 wherein the downstream end of said shaft ends in a point and the associated bearing is attached with a small disc, said disc being perpendicular to said shaft such that said end of shaft makes a point contact with said disc while said shaft rotates.

6. The invention of claim 1 wherein each said bearing is held by arms, which are affixed to a ring, said ring having a cut and snugly fitting the inner diameter of said heat exchanger tube.

* * * * *